United States Patent [19]

Annen et al.

[11] Patent Number: 5,013,328

[45] Date of Patent: May 7, 1991

[54] AFTERTREATMENT OF DYED SUBSTRATES

[75] Inventors: Oskar Annen, Aesch; Bernhard Schlick, Basel, both of Switzerland

[73] Assignee: Sandoz Ltd., Basel, Switzerland

[21] Appl. No.: 437,481

[22] Filed: Nov. 15, 1989

Related U.S. Application Data

[63] Continuation of Ser. No. 270,938, Nov. 14, 1988, abandoned.

[51] Int. Cl.[5] ..... D06P 1/39; D06P 3/60; D06P 5/08

[52] U.S. Cl. ..... 8/442; 8/154; 8/155; 8/531; 8/532; 8/533; 8/534; 8/918; 8/648

[58] Field of Search ..... 8/442, 551, 556

[56] References Cited

U.S. PATENT DOCUMENTS

| | | | |
|---|---|---|---|
| 4,410,652 | 10/1983 | Robinson et al. | 8/496 |
| 4,504,640 | 3/1985 | Harada et al. | 526/193 |
| 4,528,347 | 7/1985 | Harada et al. | 526/219 |
| 4,583,989 | 4/1986 | Ueda et al. | 8/543 |
| 4,764,585 | 8/1988 | Heller et al. | 8/536 |
| 4,810,254 | 3/1989 | Bayer et al. | 8/554 |
| 4,812,540 | 3/1989 | Kageno et al. | 526/218.1 |

*Primary Examiner*—A. Lionel Clingman

*Attorney, Agent, or Firm*—Gerald D. Sharkin; Richard E. Vila; Thomas C. Doyle

[57] ABSTRACT

A substrate to which a dyestuff or optical brightener has been applied is aftertreated with a cationic or protonatable polymeric Product P selected from:

(A) a polymeric reaction product, Product A, of a monofunctional or polyfunctional amine having one or more primary and/or secondary and/or tertiary amino groups with cyanamide, dicyanamide, guanidine or bisguanidine in which up to 50 mole percent of the cyanamide, dicyanamide, guanidine or bisguanidine may be replaced by a dicarboxylic acid or a mono- or di-ester thereof, with the splitting off ammonia, optionally in the presence of a catalyst; Product A containing at least one free hydrogen atom linked to a nitrogen atom; or (B) the polymeric reaction product, Product B, of Product A with (a) epichlorohydrin or a precursor thereof; or (b) an N-methylol derivative of a urea, melamine, guanamine, triazinone, urone, carbamate or acid amine optionally in the presence of a catalyst for crosslinking N-methylol compounds; or (c) a water-soluble homo- or co-polymer, Product C, of monoallylamines, diallylamines and/or triallylamines;

Product P being applied in the presence of an assistant comprising an anionic Component I and a non-ionic component Component II;

Component I being selected from $C_{11-18}$alkane sulphonic acids, aryl$C_{1-22}$alkylbenzene sulphonic acids, $C_{8-22}$ fatty amide amine sulphonic acids; amidobenzene benzenesulphonic acids, Turkey red oil, $C_{1-22}$alkyl-aryl disulphonic acids; $C_{1-22}$alkyl arylaryl sulphonic acids and sulphonated or sulphated products of phenols, phenol$C_{1-6}$alkyl ethers; naphthol, naphthalene, benzylnaphthalenes, phenylether sulphones, tolylether sulphone, novolak products and dinaphthylmethanes; and sulphonated aromatic formaldehyde condensation products; and Component II being the condensation product of $C_{2-4}$alkyleneoxide with a compound selected from saturated or unsaturated $C_{8-22}$ fatty alcohol, a $C_{3-22}$ secondary alcohol, $C_{1-22}$alkylphenol and a carboxylic acid. a

20 Claims, No Drawings

AFTERTREATMENT OF DYED SUBSTRATES

This is a continuation of application Ser. No. 07/270,938, filed Nov. 14, 1988, now abandoned.

The invention relates to a process for aftertreating of dyed, printed or padded substrates.

According to the invention, there is provided a process for the aftertreatment of a substrate to which a dyestuff or optical brightener has been applied.

comprising aftertreating the dyed, printed or padded substrates with a cationic or protonatable polymeric product (hereinafter defined as Product P) selected from:

(A) a polymeric reaction product (hereinafter defined as Product A) of a monofunctional or polyfunctional amine having one or more primary and/or secondary and/or tertiary amino groups with cyanamide, dicyanamide, guanidine or bisguanidine in which up to 50 mole percent of the cyanamide, dicyanamide, guanidine or bisguanidine may be replaced by a dicarboxylic acid or a mono- or di-ester thereof, with the splitting off ammonia, optionally in the presence of a catalyst (hereinafter defined as $K_1$); Product A containing at least one free hydrogen atom linked to a nitrogen atom; or (B) the polymeric reaction product (hereinafter defined as Product B) of Product A with (a) epichlorohydrin or a precursor thereof; or (b) an N-methylol derivative of a urea, melamine, guanamine, triazinone, urone, carbamate or acid amide optionally in the presence of a catalyst (hereinafter defined as $K_2$) for crosslinking N-methylol compounds; or (C) a water-soluble homo- or co-polymer (hereinafter defined as Product C) of monoallylamines, diallylamines and/or triallylamines;

Product P being applied in the presence of an assistant (hereinafter defined as the "assistant") comprising an anionic component (hereinafter defined as Component I) and a non-ionic or very weakly cationic component (hereinafter defined as Component II);

Component I being selected from $C_{11-18}$alkane sulphonic acids, aryl$C_{1-22}$alkylbenzene sulphonic acids, $C_{8-22}$ fatty amido amine sulphonic acids; amidobenzenesulphonic acids, Turkey red oil, $C_{1-22}$alkyl-aryl disulphonic acids; $C_{1-22}$alkyl arylaryl sulphonic acids and sulphonated or sulphated products of phenols, phenol$C_{1-6}$alkyl ethers; naphthol, naphthalene, benzylnaphthalenes, phenylether sulphones, tolylether sulphone, novolak products (for example diphenyl methane); dinaphthylmethanes; and sulphonated aromatic formaldehyde-condensation products; and Component II being the addition product of $C_{2-4}$alkyleneoxide with a compound selected from saturated or unsaturated $C_{8-22}$ fatty alcohol, $C_{8-22}$ fatty aminopropylamine, a $C_{3-22}$ secondary alcohol, $C_{1-22}$alkylphenol and a carboxylic acid.

In this Specification, preferably any aryl group is phenyl.

By the term "$C_{8-22}$fatty" is meant $C_{8-22}$alkyl or $C_{8-22}$alkenyl.

Preferably in Component II 20 to 120 moles of alkylene oxide are present per mol of alcohol, amine, phenol or acid.

Products A and B are well known and are described in U.S. Pat. No. 4,764,585 (=DOS No. 3,525,104) and U.S. Pat. No. 4,410,652 (=DOS No. 3,105,897); the contents and preferences of which are incorporated herein by reference. $K_1$ is described in U.S. Pat. No. 4,764,585 (as Catalyst K) and $K_2$ is described in U.S. Pat. No. 4,410,652 (as Catalyst C in U.S. Pat. No. 4,410,652). $K_1$ is preferably selected from metals, metal salts and heterocyclic nitrogen—containing organic bases, more preferably zinc chloride. $K_2$ is preferably a Lewis acid catalyst and includes nitrates, sulphates, chlorides, tetrafluoroborates and dihydrogen orthophosphates of aluminium, magnesium and zinc as well as aluminium hydroxychloride, zirconyloxychloride and mixtures thereof. More preferably $K_2$ is magnesium chloride or a mixture thereof with sodium sulphate.

Product C is also well known and is described in EP No. 140,309; EP No. 145,220, EP No. 95,233 and EP No. 142,337 the contents of which are incorporated herein by reference.

Preferably 0.1 to 6%, more preferably 0.5 to 3% based on the dry weight of substrate of Product P is used in a process according to the invention.

Preferably Product A is Product A' where Product A' is the product of reacting a $C_{2-5}$alkylenediamine or a poly-$C_{2-4}$alkylene-polyamine having 3 to 6 nitrogen atoms with cyanamide, dicyandiamide, guanidine or bisguanidine. More preferably Product A is Product A'' where Product A'' is the product of reacting diethylene triamine or triethylene tetraamine with dicyandiamide.

Preferably Product B is Product B' where Product B' is the reaction product of A', with epichlorohydrin or a compound selected from N,N'-dimethylol-4,5-dihydroxyethylene urea, N,N'-dimethylol-4,5-dimethoxyethylene urea, an N,N'-dimethylol carbamate or a $C_{1-4}$alkyl ether thereof.

Preferably Product P is Product P' where Product P' is Product A' or B'.

Preferably the ratio of Component I to Component II is 1–4:1 (weight ratio).

Preferably the assistant is present in an amount of 0.1 to 6%, more preferably 0.5 to 3% based on the dry weight of substrate.

Preferably Component I is selected from Turkey red oil, the condensation product of formaldehyde and an aromatic mixture sulphonated with $H_2SO_4$ having an average molecular weight of 130 to 160 derived from naphtha; a sodium salt of dinaphthylenemethane disulphonic acid or a compound of formula III, IV or V (III)

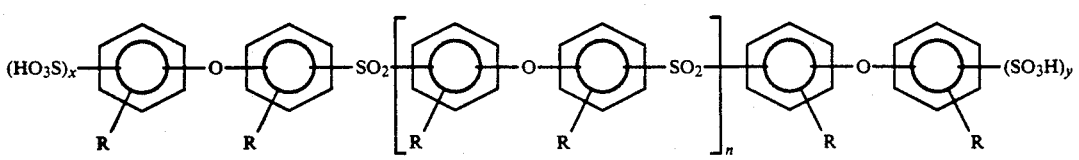

-continued

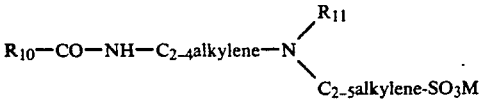

(IV)

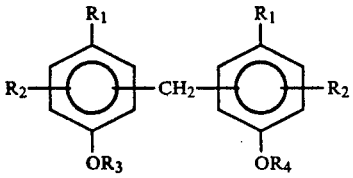

(V)

in which each $R_1$, independently, is selected from $C_{8-12}$alkyl (preferably isooctyl, nonyl or dodecyl);

$R_3$ is $-(-CH_2CH_2O)_m-R_5$; $-(-C_3H_6O-)_m-R_5$ or $-(-C_4H_8O)_m-R_5$;

$R_4$ is hydrogen or a group $-(CH_2CH_2O-)_p-R_5$; $-(-C_3H_6-O-)_p-R_5$ or $-(C_4H_8O)_p-R_5-$;

one group $R_5$ is $-SO_3R_6$, and the second $R_5$ when present is hydrogen or $-SO_3R_6$;

each $R_6$, independently, is hydrogen or an alkali metal, alkaline earth metal, $NH_4$, hydroxyalkyl ammonium or alkyl ammonium group;

each $R_2$, independently, is hydrogen or $SO_3R_6$;

m is an integer from 1 to 3 inclusive;

p is 1 or 2;

whereby the sum of m+p is not greater than 4;

each R, independently, is hydrogen or methyl (preferably methyl);

n is 0 or an integer of from 1 to 6 inclusive;

x and y, independently, are zero or 1; the sum of x+y being 1 or 2;

M is sodium, potassium or $NH_4^{\oplus}$;

$R_{10}$ is $C_{15-21}$alkyl; and $R_{11}$ is $C_{1-3}$alkyl.

Preferred compounds of formula IV are those of formula IVa.

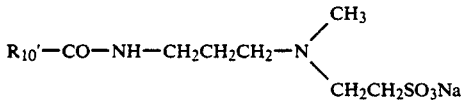

(IVa)

where $R_{10}'$ is $C_{16-18}$alkyl (preferably $C_{17}H_{35}$).

Preferred compounds of formula V are those of formula Va

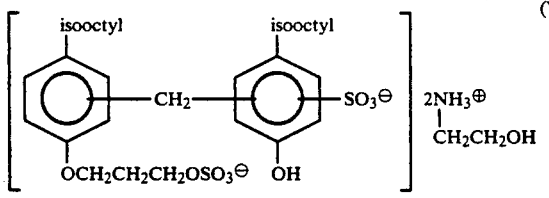

(Va)

Preferably the sulphonated condensation product of formaldehyde with the aromatic mixture is the product of reacting 0.35 moles of formaldehyde with 1 mol of the aromatic mixture which has been sulphonated (1 mol of aromatic mixture to 2 moles of $H_2SO_4$).

Preferably Component II is a $C_{14-22}$ fatty alcohol poly-$C_{2-3}$alkyleneoxide (preferably having 20 to 60 alkyleneoxide groups per molecules) or the condensation product of 1 mol of a $C_{15-22}$alkyl or $C_{15-22}$alkenylamino-propylamine and 70 to 110 moles of a $C_{2-3}$alkyleneoxide.

More preferably Component II is a mixture of 1 mol $C_{16-18}$ fatty alcohol ethoxylated with about 40 moles ethyleneoxide units or the condensation product of 1 mol of stearylaminopropylamine with 90 moles of ethyleneoxide.

Most preferably Component II is a mixture of 1 mol of a $C_{16-18}$ fatty alcohol ethoxylated with about 40 moles of ethyleneoxide.

The process according to the invention is preferably an exhaust, dipping, spraying, foam application, padding or other conventional application process, more preferably an exhaust process.

Preferably in a process according to the invention, an electrolyte is used.

The preferred electrolyte added is sodium or potassium carbonate, sodium or potassium hydroxide or sodium or potassium sulphate.

Preferably the process according to the invention is carried out in an aqueous medium. Preferably the pH is from 6 to 12 inclusive, the pH being adjusted by the addition of electrolyte.

Preferably, when the process according to the invention is an exhaust process, the bath has a goods to liquor ratio of 1:2 to 1:50.

Preferably the process according to the invention is carried out at a temperature of 20° to 70° C. inclusive.

A preferred process according to the invention comprises:

(a) placing a dyed or brightened substrate in an aqueous after-treatment bath at room temperature (20°-25° C.) containing:

0.1 to 6% based on the dry weight of substrate of Product P; and 0.1 to 6% based on the dry weight of substrate of Assistant (as herein defined) together with 5 to 10 g/l of electrolyte at a goods to liquor ratio of 1:2 to 1:50;

(b) raising the temperature of the bath over 10-20 minutes to a temperature in the range 40° to 60° C. inclusive; and (c) maintaining the substrate in the bath at this temperature for 15-25 minutes (preferably 20 minutes).

The substrate can then be taken out of the bath, washed, neutralized if necessary and dried.

Preferred substrates include hydroxy group-containing-, amino-group-containing or thiol-group-containing substrates. Such substrates include leather and preferably cellulose containing substrates including paper. More preferred substrates include textile fibre material, especially cellulose fibres alone or in combination with synthetic or natural fibres, for example polyester, polyamide and polyacrylonitrile fibres or wool. By cellulose is meant natural and/or regenerated cellulose, for example cotton, viscose or cellulose acetate. The textile material can be in different forms—for example yarn, woven fabric or knitted material.

The term "dyeing" in this Specification includes exhaust dyeing, padding or printing. Exhaust dyeing, padding or printing of the substrates can be carried out by conventional methods. In the case of a mixed fibre substrate, one part can be dyed before the other part. In such a case, dyeing may be carried out in a single bath, one stage or in single bath, two or more stage process.

However, in the case of a fibre mixture consisting of cellulose and a part which is dyeable with basic dyes, the after-treatment according to the invention can take place after dyeing the cellulose part and before dyeing the other part of the fibre mixture with the basic dyes in a further stage. In this case, the process is a three-stage one: the cellulose part is firstly dyed by known methods, the after-treatment according to the invention is carried out in a 2nd stage, and finally, the other part of the fibre mixture, for example poly-acrylonitrile fibres or polyester fibres modified by acid groups, is dyed with basic dyes in a 3rd stage or bath.

The dyes which are used for dyeing fibres of the substrate used in a process according to the invention depend on the substrate, and may belong to various classes, for example the class of acid dyes, metal complex dyes, reactive dyes, direct dyes, basic dyes or disperse dyes.

The cellulose part is advantageously dyed with direct or reactive dyes. Basically, the reactive dyes used may similarly be any water-soluble dyes which contain at least one fibre-reactive group, whose presence in the dyestuff molecule enables the dyestuff to undergo a chemical reaction with the hydroxy groups present in the textile materials. The direct dyes employed may be those which are used for dyeing cellulose or wool, preferably those which are called "reactant fixable". It is advantageous to use reactive dyes or direct dyes which exist as metal complexes.

Dyeing assistants which are otherwise usual for dyeing, pad-dyeing or printing may be used. When dyeing with direct dyes, an electrolyte such as sodium chloride or Glauber's salt is used, and in the case of reactive dyes, an alkaline fixing agent such as sodium or potassium hydroxide, carbonate, bicarbonate, silicate, borate or phosphate, or mixtures thereof, is used.

After dyeing, the substrate is rinsed, dried if required and then after-treated according to the invention.

By using a process according to the invention, dyeings and prints with good wet fastness and in particular good rubbing fastness are obtained. The process is especially suitable for dyeing yarn, of mixed fibres or mixed yarns; level dyeings and good penetration are attained. The results are particularly noticeable in the sensitive range of dark shades, for example with black dyeings.

In the following Examples, all percentages are by weight and all temperatures are given in degrees Centigrade, unless indicated to the contrary. All % are based on the dry weight of substrate being dyed.

EXAMPLE 1

Polyester/cotton yarn (67:33) which is wound on cross-wound spools is placed at 50° in a dye bath containing:

3.5% of the dyestuff C.I. Direct Black 117
25 g/l of Glauber's salt and
2 g/l of a commercial complexing agent based on a citrate.

After dyeing for 10 minutes, the pH value is adjusted to 5 by adding sodium carbonate and the bath is then heated to 90°. The following dyes are added to the dye bath:

0.016% of the C.I. Disperse Yellow 235
0.064% of the C.I. Disperse Red 73
1.6% of a commercial rapid dyeing black disperse dye and the temperature of the bath is raised to 130° at a rate of 1.5°/min. Dyeing takes place for 20 minutes at 130°, followed by cooling over 45 minutes to 70°. The dye bath is drained and the yarn rinsed. The dyed yarn is then after-treated for 20 minutes at 60° with a bath containing 1% of a compound of Example 1 of DOS No. 3,525,104 (=U.S. Pat. No. 4,764,585), 1.5% of a mixture (2:1) of Turkey red oil and $C_{16-18}$ fatty alcohol poly(40–60)glycol ether, and 5 g/l of Glauber's salt, and the yarn is finally rinsed with cold water.

The black dyeing thus after-treated has good rubbing fastness properties.

EXAMPLE 2

Polyester/cotton (67:33) yarn is dyed by the dyeing process of Example 1, rinsed and subsequently after-treated for 20 minutes at 40° in a bath containing 2% of a compound of Example 10 of DOS No. 3,525,104 (=U.S. Pat. No. 4,764,585), 1.5% of the anionic/non-ionic mixture of Example 1, 5 g/l of Glauber's salt and 2 g/l of sodium hydroxide. The yarn is then rinsed and neutralised.

The resultant dyeing has good rubbing fastness.

EXAMPLE 3

Wool/cotton mixed yarn is dyed at boiling temperature with a dye bath containing:

1.00% of the dyestuff C.I. Acid Blue 206
0.1% of the dyestuff C.I. Acid Violet 128
0.4% of the dyestuff C.I. Acid Blue 227
1.5% of the dyestuff C.I. Direct Blue 151
0.32% of the dyestuff C.I. Direct Black 62
2.00% of a commercial synthetic tannin based on a 4,4'-dihydroxydiphenylsulphone-m-xylene-sulphonic acid-formaldehyde condensation product
30.00% of Glauber's salt
3.00% of ammonium sulphate and
1.00% of 40% acetic acid.

The liquor to goods ratio is 25:1. At the end of dyeing, the dye bath is cooled over the course of 45 minutes to 60°, drained and the yarn rinsed. The dyed yarn is subsequently after-treated as described in Example 1. A mixed yarn which is dyed in a marine-blue shade and has good rubbing fastness is obtained.

EXAMPLE 4

Polyamide/cotton (PAC/CV) mixed yarn on a package is dyed in a single bath in one stage at a liquor to goods ratio of 30:1, whereby the following dyes are used:

1.00% of the dyestuff C.I. Direct Brown 240
0.35% of the dyestuff C.I. Acid Orange 127
0.13% of the dyestuff C.I. Acid Red 299
0.22% of the dyestuff C.I. Acid Blue 280
(calculated on the weight of the substrate).

After dyeing, the yarn is rinsed and subsequently after-treated for 20 minutes at 60° with a bath containing 1% of a compound of Example 1 of DOS No. 3,525,104 (=U.S. Pat. No. 4,764,585), 2% of the anionic/non-ionic mixture of Example 1 and 10 g/l of sodium chloride, and it is finally rinsed.

The resultant brown dyeing has good rubbing fastness.

EXAMPLE 5

PAC/CV (50:50) mixed yarn on a package is dyed at 90° for 95 minutes with the following bath:

60 g/l Glauber's salt
2 g/l of sodium salt of m-nitrobenzenesulphonic acid
15 g/l of soda (metered)
0.18% of C.I. Reactive Yellow 58
0.12% of C.I. Reactive Yellow 29
2.2% of C.I. Reactive Blue 18 and is subsequently given a hot and a cold rinse. This dyed yarn is then after-treated for 10 minutes at 60° in a 2nd bath containing 1.5% of a compound of Example 1 of DOS No. 3,525,104 (=U.S. Pat. No. 4,764,585), 1.5% of the anionic/non-ionic mixture of Example 1 and 10 g/l of sodium chloride, and the yarn is given a cold rinse.

The mixed yarn is then dyed at 105° in a 3rd bath containing 0.05% of the dyestuff C.I. Basic Yellow 13,
0.02% of the dyestuff C.I. Basic Yellow 82
0.12% of the dyestuff C.I. Basic Blue 3,
1 ml/l of a commercial anti-precipitant; and
1 g/l of sodium acetate.

At the end of dyeing, the dye bath is cooled to 60° and the dyed substrate is rinsed.

A green dyeing with good rubbing fastness is obtained.

EXAMPLES 5 TO 35

Examples 1 to 5 can be repeated using instead of the cationic fixing agent of Example, an equivalent amount of the compound of Example 4 of DOS No. 3,525,104 (=U.S. Pat. No. 4,764,585).

Examples 1 to 5 can be repeated using, instead of Turkey Red Oil, the same amount of the compound of Example 1 of DOS No. 3,110,411 or the compound of Example "Phenylsulphone K" of DOS No. 1,619,635 or the compound of Example 6 of DOS No. 3,442,888 or the condensation product of 0.35 moles formaldehyde with 1 mole of an aromatic mixture derived from naphtha having a M.W. of about 145, sulphonated with 2 moles of $H_2SO_4$ or the sodium salt of dinaphthylmethane disulphonic acid.

Examples 1 to 5 can be repeated using, instead of the glycol ether, the same amount of the condensation product of 1 mole of stearylaminopropylamine and 90 moles of ethyleneoxide.

The dyeings of Examples 5 to 35 have good fastness to rubbing.

What is claimed is:

1. A process for the aftertreatment of yarn to which a dyestuff or optical brightener has been applied by exhaust dyeing, which comprises applying by an exhaust process to the dyed or brightened yarn on a cross-wound spool or a package a cationic or protonatable polymeric Product P selected from:

(A) a polymeric Product A, which is a reaction product of a monofunctional or polyfunctional amine having one or more primary and/or secondary and/or tertiary amino groups with cyanamide, dicyandiamide, guanidine or bisguanidine in which up to 50 mole percent of the cyanamide, dicyandiamide, guanidine or bisguanidine may be replaced by a dicarboxylic acid or a mono- or di-ester thereof, with the splitting off of ammonia, said Product A containing at least one free hydrogen atom linked to a nitrogen atom;

(B) the polymeric Product B, which is a reaction product of Product A with
(a) epichlorohydrin or a precursor thereof; or
(b) an N-methylol derivative of a urea, melamine, guanamine, triazinone, urone, carbamate or acid amide, and (C) a water-soluble homo- or co-polymer, Product C, of monoallylamines, diallylamines and/or triallylamines; Product P being applied in the presence of an assistant comprising an anionic Component I and a non-ionic Component II;

Component I being selected from $C_{11-18}$alkane sulphonic acids, aryl$C_{1-22}$alkylbenzene sulphonic acids, $C_{8-22}$ fatty amido amine sulphonic acids; amidobenzenesulphonic acids, Turkey red oil, $C_{1-22}$alkyl-aryl disulphonic acids; $C_{1-22}$alkyl arylaryl sulphonic acids and sulphonated or sulphated products of phenols, phenol-$C_{1-6}$alkyl ethers; naphthol, naphthalene, benzylnaphthalenes, phenylether sulphones, tolylether sulphone, novolak products, dinaphthylmethanes; and sulphonated aromatic formaldehyde-condensation products; and Component II being the addition product of $C_{2-4}$alkyleneoxide with a compound selected from saturated or unsaturated $C_{8-22}$ fatty alcohol, a $C_{8-22}$ fatty aminopropylamine, $C_{3-22}$ secondary alcohol, $C_{1-22}$alkylphenol and a carboxylic acid.

2. A process according to claim 1, in which Product A is Product A' where Product A' is the product of reacting a $C_{2-5}$alkylenediamine or a poly-($C_{2-4}$alkylene) polyamine having 3 to 6 nitrogen atoms with cyanamide, dicyandiamide, guanidine or bisguanidine.

3. A process according to claim 1, in which Product A is Product A" where Product A" is the product of reacting diethylene triamine or triethylene tetraamine with dicyandiamide.

4. A process according to claim 1, in which Product B is Product B' where Product B' is the reaction product of Product A', where Product A' is the product of reacting a $C_{2-5}$alkylenediamine or a poly-($C_{2-4}$alkylene) polyamine having 3 to 6 nitrogen atoms with cyanamide, dicyandiamide, guanidine or bisguanidine, with epichlorohydrin or with N,N'-dimethylol-4,5-dihydroxyethylene urea, N,N'-dimethylol-4,5-dimethoxyethylene urea, an N,N'-dimethylol carbamate or a $C_{1-4}$alkyl ether thereof.

5. A process according to claim 1, in which Product P is Product P' where Product P' is Product A' or Product B' where Product A' is the product of reacting a $C_{2-5}$alkylenediamine or a poly-($C_{2-4}$alkylene) polyamine having 3 to 6 nitrogen atoms with cyanamide, dicyandiamide, guanidine or bisguanidine; and where Product B' is the reaction product of Product A' with epichlorohydrin or with N,N'-dimethylol-4,5-dihydroxyethylene urea, N,N'-dimethylol-4,5-dimethoxyethylene urea, an N,N'dimethylol carbamate or a $C_{1-4}$alkyl ether thereof.

6. A process according to claim 1, in which Component I is Turkey red oil, the condensation product of formaldehyde and an aromatic mixture sulphonated with $H_2SO_4$ having an average molecular weight of 130 to 160 derived from naphtha; a sodium salt of dinaphthylenemethane disulphonic acid or a compound of formula III, IV or V

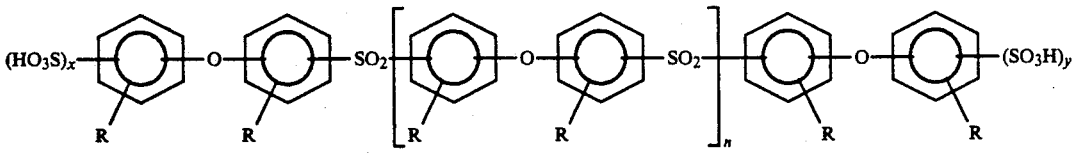

(III)

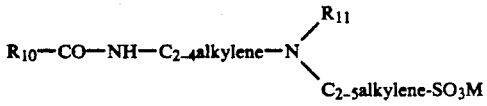

(IV)

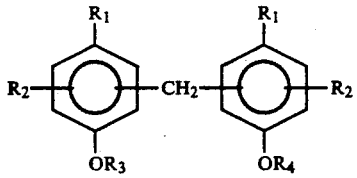

(V)

in which each $R_1$, independently, is selected from $C_{8-12}$alkyl;

$R_3$ is $-(-CH_2CH_2O)_m-R_5$; $-(-C_3H_6O-)_m-R_5$ or $-(-C_4H_8O)_m-R_5$;

$R_4$ is hydrogen or a group $-(CH_2CH_2O-)_p-R_5$; $-(-C_3H_6-O-)_p-R_5$;

one group $R_5$ is $-SO_3R_6$, and the second $R_5$ when present is hydrogen or $-SO_3R_6$;

each $R_6$, independently, is hydrogen or an alkali metal, alkaline earth metal, $NH_4$, hydroxyalkyl ammonium or alkyl ammonium group;

each $R_2$, independently, is hydrogen or $SO_3R_6$;

m is an integer from 1 to 3 inclusive;

p is 1 or 2;

whereby the sum of m+p is not greater than 4;

each R, independently, is hydrogen or methyl;

n is 0 or an integer of from 1 to 6 inclusive;

x and y, independently, are zero or 1; the sum of x+y being 1 or 2;

M is sodium, potassium or $NH_4^{\oplus}$;

$R_{10}$ is $C_{15-21}$alkyl; and $R_{11}$ is $C_{1-3}$alkyl.

7. A process according to claim 1, in which component II is a $C_{14-22}$ fatty alcohol poly-$C_{2-3}$alkylene oxide or the condensation product of 1 mole of a $C_{15-22}$alkyl or $C_{15-22}$alkenylamino-propylamine with 70–110 moles of a $C_{2-3}$alkylene oxide.

8. A process according to claim 1, in which 0.1 to 6% based on the dry weight of yarn to be treated of Product P is applied.

9. A process according to claim 1, in which 0.1 to 6% based on the dry weight of yarn to be treated of the assistant is applied.

10. A process according to claim 1 comprising (a) placing the dyed or brightened yarn in an aqueous aftertreatment bath at room temperature containing:

0.1 to 6% based on the dry weight of yarn of Product P; and 0.1 to 6% based on the dry weight of yarn of the assistant together with 5 to 10 g/l of sodium or potassium carbonate, hydroxide or sulphate at a goods to liquor ratio of 1:2 to 1:50;

(b) raising the temperature of the bath over 10–20 minutes to a temperature in the range 40° to 60° C. inclusive; and (c) maintaining the yarn in the bath at this temperature for 15–25 minutes.

11. A process according to claim 1 wherein Component II is an addition product of 20 to 120 mols of a alkyleneoxide per mol of alcohol, amine, phenol or acid.

12. A process according to claim 1 wherein the weight ratio of Component I to Component II is 1–4:1.

13. A process according to claim 1 which is carried out in an aqueous medium at a pH of 6 to 12, a temperature of 20° to 70° C. and a goods to liquor ratio of 1:2 to 1:50.

14. A process according to claim 1 wherein the yarn comprises cellulose fibers alone or in combination with polyester, natural or synthetic polyamide or polyacrylonitrile.

15. A process according to claim 6 wherein Component II is an addition product of 20 to 120 mols of alkyleneoxide per mol of alcohol, amine, phenol or acid.

16. A process according to claim 6, in which Product P is Product P' where Product P' is Product A' or Product B', where Product A' is the product of reacting a $C_{2-5}$alkylenediamine or a poly-($C_{2-4}$alkylene) polyamine having 3 to 6 nitrogen atoms with cyanamide, dicyandiamide, guanidine or bisguanidine and Product B' is the reaction product of Product A' with epichlorohydrin, N,N'-dimethylol-4,5-dihydroxyethylene urea, N,N'-dimethylol-4,5-dimethoxyethylene urea, an N,N'dimethylol carbamate or a $C_{1-4}$alkyl ether thereof and Component II is a $C_{14-22}$ fatty alcohol poly-$C_{2-3}$alkylene oxide or the condensation product of 1 mole of a $C_{15-22}$alkyl or $C_{15-22}$alkenylamino-propylamine with 70–110 moles of $C_{2-3}$alkylene oxide.

17. A process according to claim 16 wherein Product A' is Product A" where Product A" is the product of reacting diethylene triamine or triethylene tetramine with dicyandiamide.

18. A process according to claim 17 wherein 0.1 to 6% of Product and 0.1 to 6% of the assistant, based on the dry weight of yarn, are applied to the yarn and wherein the weight ratio of Component I to Component II is 1–4:1.

19. A process according to claim 18 which is carried out in an aqueous medium at a pH of 6 to 12, a temperature of 20° to 70° C. and a goods to liquor ratio of 1:2 to 1:50.

20. Dyed yarn aftertreated by a process according to claim 1.

* * * * *